US008827105B1

(12) United States Patent
Shiek

(10) Patent No.: US 8,827,105 B1
(45) Date of Patent: Sep. 9, 2014

(54) PLASTIC BAG STORAGE AND DISPENSING CONTAINER

(76) Inventor: Tomas Shiek, Wayzata, MN (US)

( * ) Notice: Subject to any disclaimer, the term of this patent is extended or adjusted under 35 U.S.C. 154(b) by 0 days.

(21) Appl. No.: 13/595,388

(22) Filed: Aug. 27, 2012

Related U.S. Application Data

(60) Provisional application No. 61/573,303, filed on Aug. 31, 2011.

(51) Int. Cl.
*B65D 8/00* (2006.01)
*B65D 83/08* (2006.01)
*B65D 69/00* (2006.01)

(52) U.S. Cl.
USPC ..... 220/676; 312/42; 206/554; 221/22; 221/90

(58) Field of Classification Search
CPC ..... A47F 9/042; A47F 13/085; A47F 1/08
USPC ..... 220/676; 312/42; 206/554; 221/22, 90, 221/61, 60
See application file for complete search history.

(56) References Cited

U.S. PATENT DOCUMENTS 3,549,226 A * 12/1970 Samson ..... 312/42
4,955,497 A * 9/1990 Winden et al. ..... 232/43.2
5,042,687 A * 8/1991 McKinley ..... 221/311
5,147,119 A * 9/1992 Harris ..... 312/49
5,341,933 A 8/1994 Willows
5,386,910 A * 2/1995 Liss ..... 206/554
5,487,467 A 1/1996 Sherman
5,582,292 A * 12/1996 Cabe ..... 206/315.1
5,657,198 A * 8/1997 Flener ..... 361/220
D414,636 S * 10/1999 Wiese ..... D6/515
D415,914 S 11/1999 Shields
6,012,843 A 1/2000 Brooks et al.
6,086,253 A 7/2000 Hartsfield
6,190,045 B1 2/2001 Schulman
D494,366 S 8/2004 Gognat et al.
7,201,283 B2 4/2007 Matuszewski
D592,419 S * 5/2009 Feeney ..... D6/408
D672,661 S * 12/2012 Hora et al. ..... D9/734
2006/0180596 A1* 8/2006 Young et al. ..... 221/63
2007/0000936 A1* 1/2007 Wu et al. ..... 221/48
2010/0300363 A1* 12/2010 Nangia ..... 119/51.01

* cited by examiner

*Primary Examiner* — Fenn Mathew
*Assistant Examiner* — Don M Anderson
(74) *Attorney, Agent, or Firm* — Eggink & Eggink; Anthony G. Eggink; Katrina M. Eggink

(57) ABSTRACT

A plastic bag storage and dispensing container having an elongated tubular structure with contoured top and bottom ends each having a formed opening. An elongated slot extends between the formed openings of the contoured top and bottom for receiving and dispensing collapsed plastic bags. The storage and dispensing container has mounting structures for mounting the container in a vertical or horizontal orientation to a wall, either a flat wall or in a wall corner, and may be provided with a vanity door cover to cover and expose the elongated slot.

17 Claims, 3 Drawing Sheets

PLASTIC BAG STORAGE AND DISPENSING CONTAINER

This application claims the benefit of U.S. Provisional Patent Application Ser. No. 61/573,303, filed Aug. 31, 2011.

BACKGROUND OF THE INVENTION

The present invention relates generally to an organized storage and dispensing container. Particularly, the present invention relates to a storage and dispensing container for plastic bags.

The benefits and problems relating to plastic bags and particularly to plastic grocery and shopping bags are well known. The thin plastic bags provided to shoppers at grocery stores and retail merchandise establishments are useful to transport purchased merchandise from the stores to the shopper's destination. However, thereafter, the accumulation of used plastic shopping bags often become bulky, troublesome and burdensome items. The empty bags are typically shoved into overstuffed drawers or the like, where they often become hard to contain, find and to retrieve when necessary.

The benefits of used plastic shopping bags are also well known. They often become liners for garbage receptacles and to store trash and debris, both indoors and outdoors as well as used for the pick-up of animal feces for subsequent disposal amongst other things, for example.

The main problem associated with used plastic bags is the time between initial use at the grocery store and their subsequent and multiple use as a recycled plastic shopping bag.

In the past, a number of prior art storage devices have been proposed for used plastic bags. These prior art storage devices have typically comprised flexible bag-like structures into which the used bags are stuffed and from which they are retrieved. These prior art devices have all suffered from inherent problems and difficulties.

The plastic bag storage and dispensing container of the present invention overcomes the difficulties and shortcomings of the prior art by providing a rigid or semi-rigid container which is easily mounted in a variety of positions and locations for convenient access and use.

SUMMARY OF THE INVENTION

A plastic bag storage and dispensing container having a unitary, elongated tubular structure having contoured end portions. The contoured end portions form top and bottom portions and each has a formed opening to provide access to the internal cavity of the tubular container structure. The formed openings in the top and bottom portions provide entry/exit openings in the contoured ends of the tubular structure. An elongated slit or slot extends between the formed openings of the contoured ends to facilitate stuffing of the main portion of a collapsed plastic bag into the upper opening which is then slid downward by the bag handle while the collapsed bag portion stacks and accumulates within the internal cavity of the tubular structure. The elongated slot allows the used plastic bags to be easily slid along the slot length for entry or removal through the formed openings in the contoured top and bottom ends.

Mounting structures, such as flattened areas, are part of the molded elongated tube body. The mounting structures may have screw apertures or slots and be provided on the back of the tubular structure, for example, opposite the elongated slit. The mounting structures allow the container to be easily mounted in a vertical or horizontal orientation on a flat surface or in a wall corner, for example. A stabilizing member may also be provided between the mounting structures.

The plastic bag storage and dispensing container structure and configuration may be a molded polymeric cylindrical body structure having contoured top and bottom ends, each with formed openings. The cylindrical body may be provided with a hinged and/or removable curved vanity cover door member to cover and provide access to the elongated slit for inserting bags and to expose the handle portions of the collapsed plastic bags for removal.

An advantage of the present invention is to provide a plastic bag storage and dispensing container which may be economically molded of a polymeric composition.

Another advantage is to provide a storage and dispensing container for grocery, department and convenience store plastic bags which may be mounted vertically or horizontally in a variety of convenient indoor and outdoor locations.

Another advantage is to provide a storage and dispensing container designed for easy use by left and right handed users.

Another advantage of the invention is to provide a plastic bag storage and dispensing container which may have a vanity door cover member which may be hinged and behind which the collapsed plastic bag handles are accessible for retrieval and use.

These and other advantages of this invention will become clear from the following description by reference to the drawings.

DESCRIPTION OF THE PREFERRED EMBODIMENTS

Figure 1:
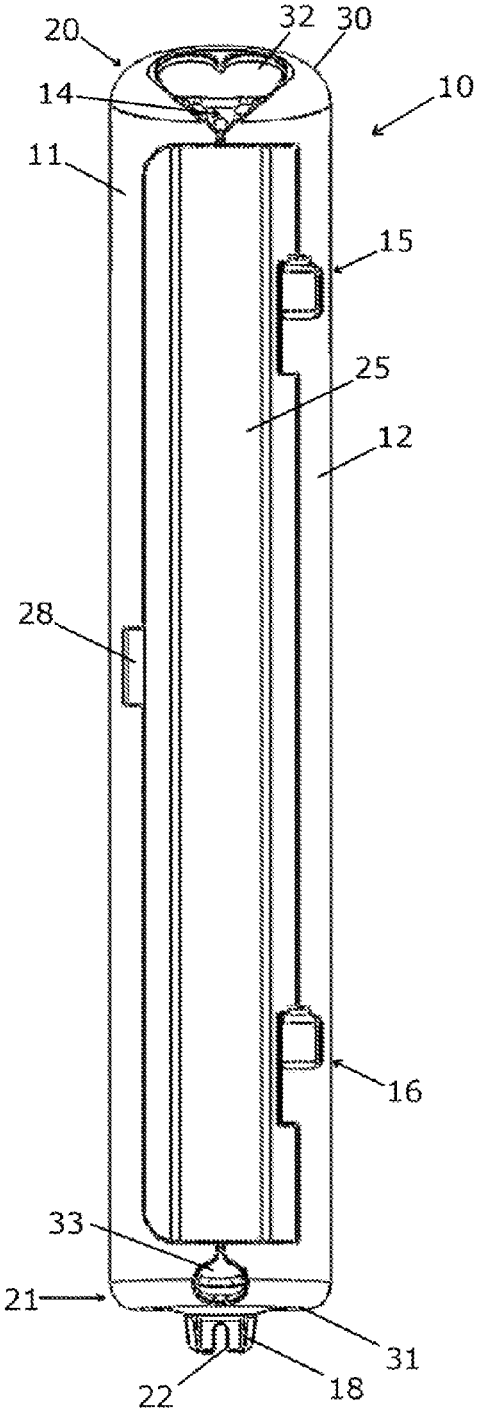
FIG. 1 is a frontal perspective view showing the plastic bag storage and dispensing container of the invention.

Referring to FIGS. 1-4, the plastic bag storage and dispensing container 10 is shown having a unitary tubular structure 11 with a peripheral wall 12 and a contoured top 30 with a formed opening 32 and contoured bottom 31 with a formed opening 33. A slot 13 is shown extending from the formed opening 32 to formed opening 33. The unitary container 10 with tubular structure 11 is shown having a generally cylindrical shape although it is within the purview of the invention to provide a tubular-like structure having other cross-sectional geometric shapes.

Figure 2:
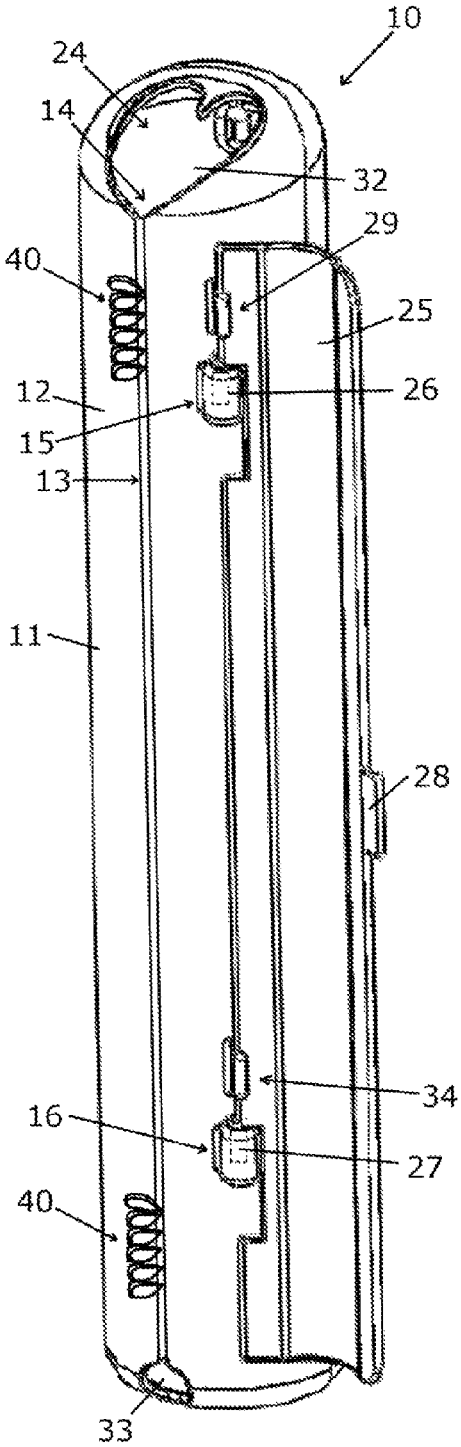
FIG. 2 is a frontal perspective view showing the storage and dispensing container of FIG. 1 having the door cover member open to expose the elongated slot.

As shown in FIG. 1, the tubular structure 11 has a first end 20 and a second end 21. Although the respective ends are shown as a rounded contoured top 30 and rounded contoured bottom 31, the storage and dispensing container 10 may be mounted in a vertical, horizontal or other directional orientation. Importantly, an elongated slot 13 extends from the formed opening 32 of the contoured top 30 of the first end 20 to the formed opening 33 of the contoured bottom 31 of the second end 21. The formed top opening 32 is shown to have a generally heart shaped opening with a generally V-shaped entry/exit portion 14 merging with slot 13. The generally heart shaped opening 32 provides for the entry of the hand of a user and accommodates both the left and the right hand. A generally circular exit portion is provided by the formed bottom opening 33 at second end 21. The generally V-shaped or tapered entry 14 of the formed top opening 32 and the width of the elongated slot 13 permits a user to easily slide a collapsed plastic bag into the internal cavity 24 of the tubular structure 11 and sliding a portion of the collapsed plastic bag, i.e., a bag handle 40, into and down slot 13, as shown in FIG. 2. The heart shaped opening 32 is shaped and positioned in the rounded top 30 to allow the fingers of either a left or right hand to easily push the crumpled, collapsed body of a bag into the internal cavity 24 of the tubular structure 11.

Figure 3:
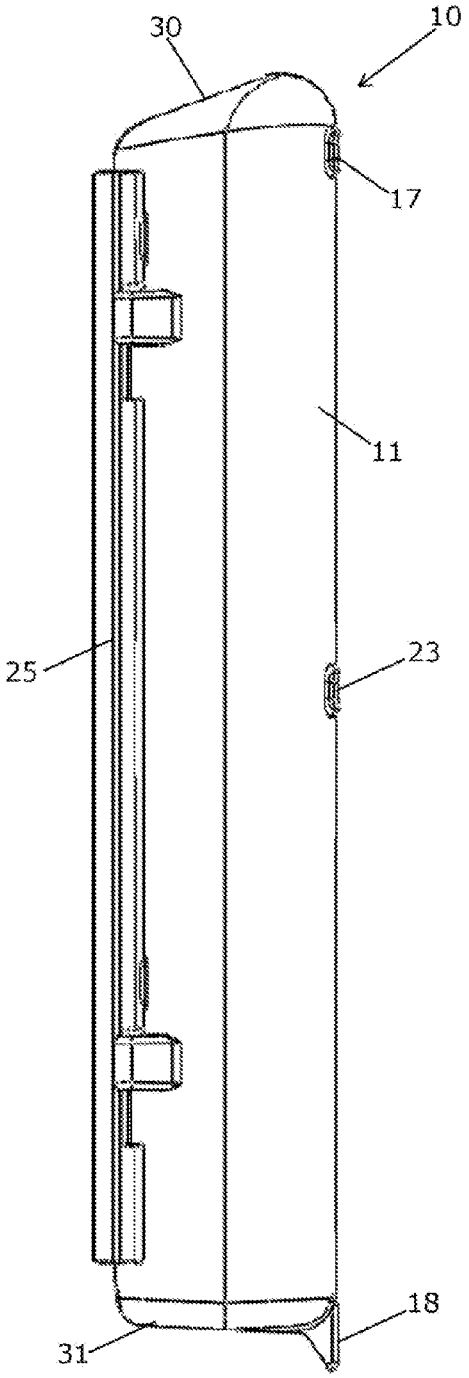
FIG. 3 is a lateral view showing the storage and dispensing container of FIG. 1.
Figure 4:
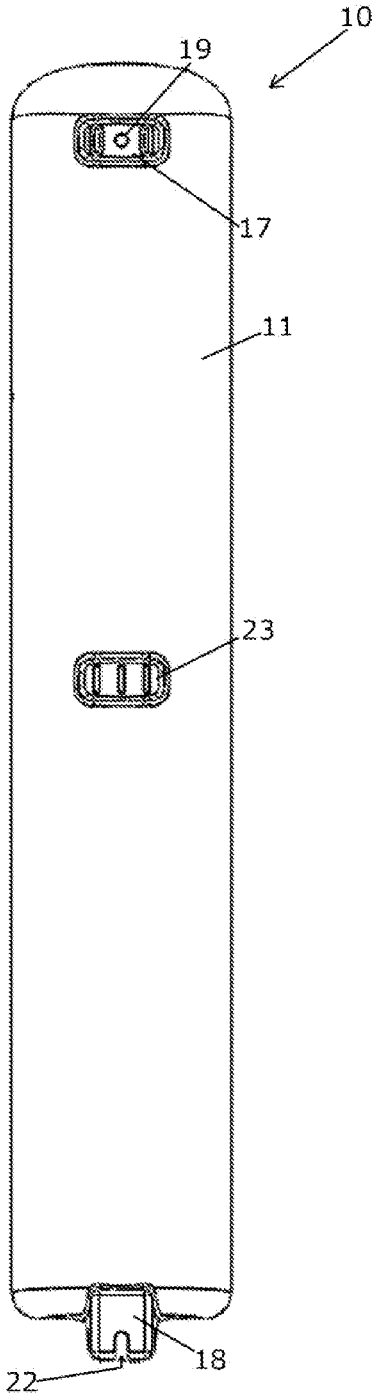
FIG. 4 is a rear view of the storage and dispensing container of FIG. 1.

Referring to FIGS. 3-4, the tubular structure 11 is shown having flattened mounting portions 17 and 18 on the back side of the tubular structure 11 of the storage and dispensing container 10. The upper mounting portion 17 is shown having a screw aperture 19 for receiving a fastening member, i.e., a screw or the like. The bottom mounting portion 18 is shown comprising a tab 18 having a slot 22 to receive a fastener such as a screw or the like. Other mounting means are within the purview of the invention. A flattened stabilizing member 23 is shown disposed on the back of tubular structure 11 in generally the middle portion between mounting structures 17, 18.

Figure 6:
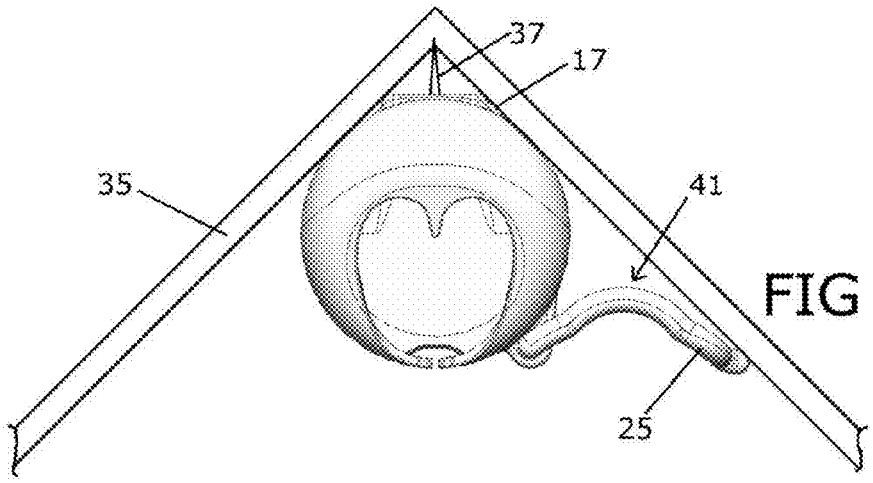
FIG. 6 is a top view showing the storage and dispensing container mounted in a corner.
Figure 7:
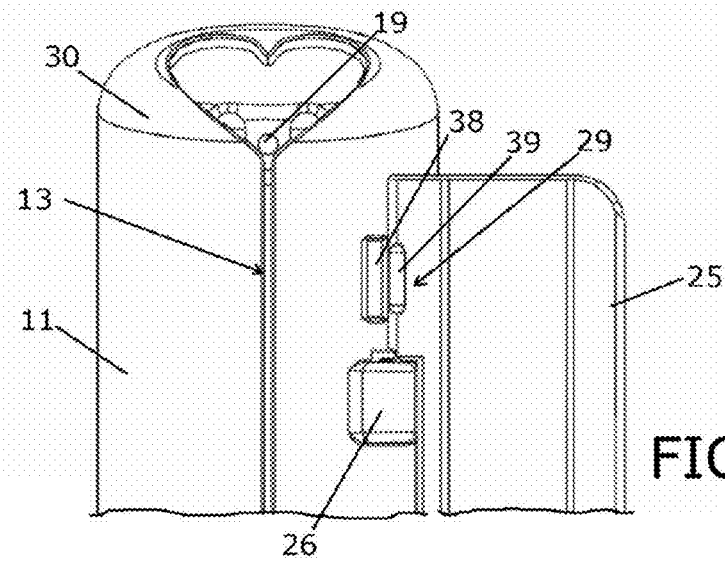
FIG. 7 is a frontal enlarged view showing the door cover member and latching mechanism of the storage and dispensing container of FIG. 1.

FIGS. 2 and 7 show the curved door cover member 25 having hinge members 15 and 16 which utilize hinge pegs 26, 27 and which allow the door cover member 25 to be easily mounted and removed. When in place, handle 28 of door cover member 25 may be used to pivot the door cover member 25 away from elongated slot 13 to allow a user to view, store or retrieve a collapsed plastic bag having handle member 40 as shown in FIG. 2. As shown particularly in FIGS. 5 and 6, the cover door member 25 is shown to have an outwardly bulged or convex portion 41 which accommodates the bag handles extending outward from the elongated slot 13.

Referring further to FIGS. 2 and 7, door locking structures 29 and 34 are shown comprising an indented portion 38 into the tubular structure 11 and a cooperating elliptical protrusion 39 extending from the edge of the door cover 25. The entry of the elliptical protrusion 39 into the indented portion 38 results into the frictional locking condition of the door cover member 25 with respect to the elongated slot 13.

Although the hinged pivot structures 15, 16 are shown in FIGS. 1-3 and 7, other opening and closing means for the door cover member may be utilized with the tubular structure 11 of the invention. The plastic bag storage and display container 10 of the invention as well as the cover member 25 may be molded of a polymeric or plastic material or the like.

An exemplary storage and dispensing container 10 of the invention may have a length of approximately 24 inches and an inside diameter ranging from approximately 4.25 to 4.50 inches. The slot 13 width may be of a small or narrow dimension, i.e., 1/16 inch or 2 mm and larger. The hinged or removable vanity door cover member 25 may have a width of approximately 2-3 inches and a length of approximately 23 inches, for example. This container structure may store in excess of 50 plus compressed plastic bags.

The configuration of the mounting structures 17, 18 essentially permit the storage and dispensing container 10 to be secured within a 90° corner and/or to a flat wall in a vertical or horizontal orientation, i.e., under a cabinet or work bench indoors, in a garage or on a patio railing or fence in an outdoor setting. The plastic bag storage and dispensing container of the invention provides an economical and versatile means to provide for the useful storage and dispensing of used plastic shopping bags in a more organized and confined space.

When the container is mounted in an upright position, empty bags may be stuffed into the top of the tube and pulled out from both top and bottom ends. When the tube is mounted in a horizontal position, empty bags may be stuffed into the entry of the tube and can also be removed from both ends. The door cover structure shown and described is an optional vanity cover member and when used to cover the tube slot it may be mounted in any known manner, i.e., via hinges, frictional fits, hanging from the tube top, etc. Covers are not necessary for the storing and dispensing function of the plastic bag tube holder of this invention.

Figure 5:
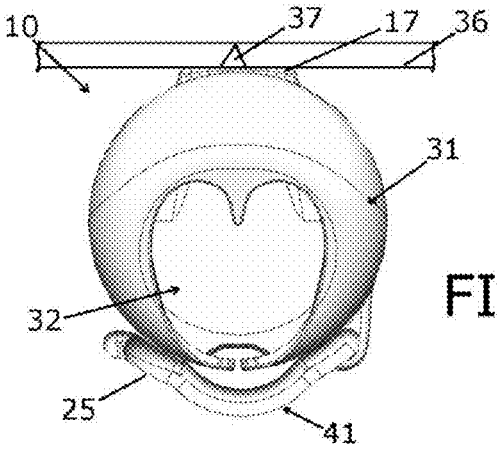
FIG. 5 is a top view showing the storage and dispensing container mounted on a wall.

FIGS. 5 and 6 show plastic bag storage and dispensing container 10 having a sturdy mount 17 to accommodate mounting into a 90 degree wall corner 35 by means of screw 37. In FIG. 5 the plastic bag storage and dispensing container 10 is shown having a mount 17 having a flat back portion spaced from the tubular body 11. The flat portions of the mounts 17 and 18 permit the container to be mounted to flat wall surface 36 by means of screw 37, for example. The configurations of mounts 17 and 18 allow the container 10 to be mounted either in a wall corner, as shown in FIG. 6, or alternatively on a flat wall surface as shown in FIG. 5. Conversely, the configuration of mounts 17 and 18 allow container 10 to be mounted either on a flat wall surface, as shown, or in a wall corner. As shown in FIG. 6, the mounts have a size relative to tubular body 11 whereby the outside edges of mount 17 and the periphery of the tubular body 11 are shown to touch wall 35 when mounted in a 90° corner. It is therefore within the purview of the invention to utilize mounting structure(s) that allow the mounting of the container in a corner, on a flat surface or horizontally to the bottom of a bench, cabinet or the like.

It is within the purview of the invention to provide a plastic bag storage and container having a plurality of container structures, for example, a pair of joined cylindrical containers to thereby provide a multiple container structure designed to store different style and sized plastic bags. For example, small or thin walled, plastic bags, i.e., bags dispensed at grocery store produce or meat departments may be stored in a smaller diameter container whereas the typical sized plastic grocery bags may be stored for retrieval in a larger container. The joined containers may be molded as a unitary structure.

The storage container embodiments of the invention may be molded as a unitary structure of a plastic, such as, PVC, nylon, styrene and the like. The plastic may also be colored as desired, such as a white or other color. The molding process may include the molding of tubular pieces, for example, which may subsequently be joined together to form the storage and dispensing container of the invention. The bag storage tubular container may be used in many locations, for example, but not limited to, in a pantry, in a hall closet, an out of the way kitchen corner, in a garage, in a laundry room, in a mudroom, in a basement stairwell, in a broom closet, in a utility cabinet, on a patio, at the cabin and in other locations. As shown, the invention embodiments may include the use of joined multiple tubes, each having a different interior diameter to accommodate different style bags.

In use, a plastic bag is collapsed and stripped to empty the air from inside the bag. The empty bag is then folded and stuffed into the top opening of the tube and at least one bag handle is then slid down the slot. An empty bag can be retrieved from the opening of either the top or bottom end of the tube. Regarding the bag collapsing process to remove air from the plastic bags a "Grip, Strip, Flip, Stuff and Slip" process may be used as follows:

1. "Grip" the bottom of the bag between thumb and fingers of one hand.
2. "Strip" the bag by placing the other hand over the fingers of the gripping hand to encircle the bag and then lightly squeezing and stripping the air out of the bag as the bag is flattened when the encircled hand is moved along the bag length.
3. "Flip" or fold to bunch up or crumple together the flattened bag.
4. "Stuff" the bunched up bag bottom first into the tube opening while holding one or both bag handles and sliding the bag downward into the slot of the tube. The bag may expand somewhat while stored.
5. "Slip" handle down in slot.
6. When ready to use a bag, grab the top bag handle or the bottom bag handle and slide it out. Top bags slide up; bottom bags slide down.

As many changes are possible to the plastic bag storage and dispensing container embodiments of this invention utilizing the teachings thereof, the descriptions above, and the accompanying drawing should be interpreted in the illustrative and not in the limited sense.

That which is claimed is:

1. A plastic bag storage and dispensing container comprising:

a) an elongated, tubular structure having an arcuate peripheral wall, a top end, a bottom end and defining an internal cavity for storing a plurality of collapsed plastic bags, said arcuate peripheral wall of said tubular structure having an outside surface;

b) an elongated narrow slot extending through said peripheral wall from said top end to said bottom end of said elongated tubular structure, said elongated narrow slot having a specified uniform width of approximately two mm and having smooth round edges to receive and hold a tab end or a portion of each collapsed plastic bag so as to be able to pull on the tab end or portion of a plastic bag up or down said elongated narrow slot for removal of the plastic bag from said top end or said bottom end of said elongated tubular structure;

c) a formed entry opening to receive the bulk of a collapsed bag, said formed entry opening having a generally V-shaped entry portion extending from said formed entry opening in said top end and to said elongated slot to facilitate the entry and removal of the collapsed plastic bag;

d) means to mount said tubular structure comprising a radially extending flattened portion unitary with said tubular structure and extending from said outside surface of said peripheral wall at a location generally opposite said elongated narrow slot, said flattened portion having opposing outside edges, said flattened portion extending from and along said arcuate peripheral wall of said tubular member a distance of approximately a 45 degree segment to thereby permit mounting of said plastic bag storage and dispensing container on a flat surface and in a 90 degree wall corner whereby said opposing outside edges of said flattened portion and said peripheral wall of said tubular structure are both able to make contact with each wall of the corner when mounted; and e) said formed entry opening having heart shaped configuration and having smooth rounded edges, said heart shaped opening merging with said V-shaped entry portion and said elongated narrow slot to form a tapered channel to receive and hold plastic bag handles or a portion of a collapsed plastic bag, whereby a user may use the left or right hand to store and retrieve plastic bags into and from said plastic bag storage and dispensing container.

2. The plastic bag storage and dispensing container of claim 1, wherein said elongated tubular structure is comprised of a cylindrical structure and formed of a molded polymeric composition.

3. The plastic bag storage and dispensing container of claim 1, wherein said elongated tubular structure includes an elongated door cover member mounted to said tubular structure adjacent said elongated narrow slot and being constructed for covering the tab ends or portions of a plastic bag extending from said elongated narrow slot.

4. The plastic bag storage and dispensing container of claim 3, wherein said door cover member has a curved configuration and is joined to said tubular structure by means of a hinge member.

5. The plastic bag storage and dispensing container of claim 4, wherein two said hinge members are provided and wherein said door cover member is removable from said two hinge members.

6. The plastic bag storage and dispensing container of claim 4, wherein said door cover member and said tubular member have cooperating locking structures.

7. The plastic bag storage and dispensing container of claim 1, wherein said flattened portion has an aperture for receiving a fastener member.

8. The plastic bag storage and dispensing container of claim 2, wherein said elongated tubular structure has a length of approximately 24 inches and has an inside diameter ranging between approximately 4.0 to 4.5 inches.

9. The plastic bag storage and dispensing container of claim 7, wherein two flattened portions are provided for mounting said container, one said flattened portion being disposed on the back of said peripheral wall of said tubular structure adjacent said top and bottom ends, respectively.

10. A storage and dispensing container for plastic bags comprising:

a) a unitary elongated tubular structure formed of a rigid or semirigid material and having profiled top and bottom ends, each profiled end having a formed opening, said elongated tubular structure having a center axis extending longitudinally therethrough;

b) an elongated narrow slot extending between said formed openings of said top and bottom ends, so as to be able to pull on a handle end or portion of a plastic bag up or down said elongated narrow slot for removal of the bag from said formed opening of said top end or said bottom end of said elongated tubular structure;

c) mounting means formed on said elongated tubular structure said mounting means having flattened areas unitary with said tubular structure and disposed on the back of said elongated tubular structure spacially from and generally opposite said elongated narrow slot to provide for mounting said plastic bag storage and dispensing container on flat surfaces and in wall corners, said flattened areas of said mounting means extending from an approximately 45 degree segment of said tubular structure; and d) said formed openings including a top opening and a bottom opening and wherein said formed top opening has a heart shaped configuration extending downward from said profiled top end at approximately the center axis of said elongated tubular structure, each said formed opening having smooth rounded edges and said elongated narrow slot having smooth rounded edges to form a channel to receive and hold plastic bag handles or portions of plastic bags, whereby a user may use the left or right hand to store and retrieve plastic bags in and from said elongated narrow slot of said elongated tubular structure of said storage and dispensing container.

11. The storage and dispensing container for plastic bags of claim 10, wherein said profiled top and bottom ends are of a rounded configuration.

12. The storage and dispensing container for plastic bags of claim 10, wherein said unitary elongated tubular structure is formed of a molded polymeric material.

13. The storage and dispensing container for plastic bags of claim 10, wherein a hinged door cover member is mounted to said elongated tubular member to cover said elongated slot, said elongated tubular member having an upper post and a lower post extending outwardly from said tubular member adjacent said elongated narrow slot for receiving said hinged door cover member.

14. The storage and dispensing container for plastic bags of claim 10, wherein a stabilizing member is provided intermediate said mounting means and wherein said mounting means includes a bottom mounting member comprising a tab with a slot.

15. A plastic bag storage and dispensing container comprising:

a) a tubular member having a front portion, a back portion, an exterior surface, a formed top portion and a formed bottom portion, said formed top portion having a top opening and said formed bottom portion having a bottom opening;

b) an elongated narrow slot extending from said top opening in said formed top portion to said bottom opening in said formed bottom portion of said tubular member, said elongated narrow slot having smooth rounded edges, said elongated narrow slot constructed to receive and hold plastic bag handles or a portion of a collapsed plastic bag in an indexed manner so as to be able to move plastic bags up or down said narrow slot for removal of the plastic bags from said formed top portion and said formed bottom portion of said tubular member;

c) said tubular member having an upper post and an aligned lower post extending outwardly from said tubular member adjacent said elongated narrow slot and mounting means extending from said back portion of said tubular member;

d) a removable door member mounted on said aligned upper and lower posts extending from said tubular member to cover said elongated narrow slot in said tubular member, said removable door member further having an elongated, bulging, convex outwardly extending portion in alignment with said elongated narrow slot of said tubular member when said door member is in a closed position to thereby accommodate and cover the plastic bag handles held in and extending from said elongated narrow slot, said removable door member further having a frictional locking structure comprising an indented portion in said front portion of said tubular member and a cooperating elliptically sloped protrusion extending from said door member, said removable door member further having a terminal edge for grasping by a user, said terminal edge of said removable door member extending from said tubular member when said door member is in a closed position; and e) said mounting means further comprising an aperture at the top of said back portion of said tubular member and a slotted tab at said back portion of said tubular member.

16. The plastic bag storage and dispensing container of claim 15, wherein said formed top portion of said tubular member has a rounded configuration and wherein said top opening has a generally heart shape having a V-shaped bottom merging into said elongated slot.

17. The plastic bag storage and dispensing container of claim 15, wherein said tubular member and said door member are formed of molded polymeric material, wherein said back portion of said tubular member has a stabilizing member.

* * * * *